US011674387B2

(12) United States Patent
Dupont et al.

(10) Patent No.: US 11,674,387 B2
(45) Date of Patent: Jun. 13, 2023

(54) INSTRUMENTED PACKER HAVING DISTRIBUTED FIBER OPTIC SENSOR

(71) Applicant: Schlumberger Technology Corporation, Sugar Land, TX (US)

(72) Inventors: Hugues Dupont, Abbeville (FR); Thomas Berard, Clamart (FR); Colin Allan Wilson, Sugar Land, TX (US); Pierre-Yves Corre, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/180,923

(22) Filed: Feb. 22, 2021

(65) Prior Publication Data

US 2021/0262343 A1 Aug. 26, 2021

Related U.S. Application Data

(60) Provisional application No. 62/978,956, filed on Feb. 20, 2020.

(51) Int. Cl.
*E21B 47/135* (2012.01)
*E21B 33/127* (2006.01)

(52) U.S. Cl.
CPC ..... *E21B 47/135* (2020.05); *E21B 33/127* (2013.01)

(58) Field of Classification Search
CPC .. E21B 47/135; E21B 33/127; E21B 33/1208; E21B 33/1243
See application file for complete search history.

(56) References Cited

U.S. PATENT DOCUMENTS

| | | | | |
|---|---|---|---|---|
| 2,828,823 | A * | 4/1958 | Mounce | E21B 33/1277 277/331 |
| 8,430,163 | B2 | 4/2013 | Dupont | |
| 10,036,247 | B2 | 7/2018 | Moronkeji | |
| 2004/0231429 | A1* | 11/2004 | Niezgorski | G01L 1/246 73/800 |
| 2011/0061862 | A1* | 3/2011 | Loretz | E21B 33/1208 166/250.11 |
| 2014/0116726 | A1 | 5/2014 | Airey et al. | |
| 2017/0138187 | A1* | 5/2017 | Moronkeji | E21B 43/26 |
| 2018/0274953 | A1* | 9/2018 | Molteni | G01D 5/35358 |
| 2019/0064387 | A1 | 2/2019 | Ohanian, III et al. | |

OTHER PUBLICATIONS

Laboratory and field verification of a new approach to stress measurements using a dilatometer tool, T. Ito, A. Sato, K. Hayashi, International Journal of Rock Mechanics & Mining Sciences 38 (2001) 1173-1184 (12 pages).

* cited by examiner

*Primary Examiner* — Kristyn A Hall
(74) *Attorney, Agent, or Firm* — Michael L. Flynn

(57) ABSTRACT

The disclosure relates to a method of evaluating characteristics of an earth formation, comprising deploying a packer assembly in a borehole penetrating an earth formation, the packer assembly comprising an instrumented inflatable packer element including fiber optic sensors; inflating the instrumented inflatable packer elements; detecting, using the fiber optic sensors, events occurring in the earth formation; and transmitting data corresponding to the detected events to a surface processing system. The disclosure also relates to a packer element and a instrumented packer assembly system. The disclosure may enable to derive formation characteristic in several configurations such as a stress test or a hydraulic fracturing configuration.

16 Claims, 11 Drawing Sheets

INSTRUMENTED PACKER HAVING DISTRIBUTED FIBER OPTIC SENSOR

This application claims priority to and the benefit of a U.S. Provisional Application having Ser. No. 62/978,956, filed 20 Feb. 2020, which is incorporated by reference herein.

BACKGROUND

Hydrocarbon fluids such as oil and natural gas are obtained from a subterranean geologic formation, referred to as a reservoir, by drilling a well that penetrates the hydrocarbon-bearing formation. Distributed fiber optic sensing systems can be used to provide information regarding the formation or borehole (ie pressure, temperature or strain). For example, crosswell seismic survey systems have been implemented in which a downhole seismic or acoustic source is positioned in a first wellbore that penetrates the formation and a distributed fiber optic vibration sensor is positioned in a second well that penetrates the earth formation. Activation of the acoustic sources generates seismic events that propagate through the formation. Detection of the seismic events by the distributed fiber optic vibration sensor provides information that can be processed to generate an image of the hydrocarbon-bearing formation. However, such techniques require the use of a nearby well, which often may not be available. Distributed fiber optic sensing systems may sense other events of the borehole, and can therefore be used several types of events, such as borehole deformation events, flow events.

SUMMARY

Techniques for deploying a fiber optic today involve permanently deploying the fiber optic into a wellbore or deploying the fiber optic as part of a wireline cable. Deployment of the fiber optic as part of the wireline cable may not always enable a perfect coupling with the wellbore. Plus, it does not enable to use distributed fiber optic sensing for all available applications.

The disclosure relates to a method of evaluating characteristics of an earth formation, comprising deploying a packer assembly in a borehole penetrating an earth formation, the packer assembly comprising an instrumented inflatable packer element including fiber optic sensors; inflating the instrumented inflatable packer elements; detecting, using the fiber optic sensors, events occurring in the earth formation; and transmitting data corresponding to the detected events to a surface processing system.

Having the fiber optic on the packer enables a good coupling of the packer and the formation. Plus, it enables the distributed fiber optic sensing to be used in several applications where deformation of the borehole around the packer needs to be sensed, such as a stress test.

The disclosure also relates to an instrumented packer system for evaluating an earth formation, comprising at least a packer assembly deployed in a borehole extending from an earth surface into a formation, the packer assembly comprising an inflatable section extending between a first end and a second longitudinal end, the inflatable section made of an elastomeric material reinforced with a plurality of reinforcement cables and operable to be inflated within a borehole; wherein each reinforcement cable extends essentially along a longitudinal axis of the packer element, a fiber optic sensor set in the elastomeric material between the first and second longitudinal ends and extending along a length of one of the reinforcement cable, the fiber optic sensor configured to respond to events occurring within a region of interest. The system further comprises an optical source to launch optical pulses into the distributed fiber optic sensor; and a data acquisition system coupled to the distributed fiber optic sensor to detect backscattered optical signals generated by the distributed fiber optic sensor in response the launched optical pulses to determine characteristics of the formation.

The disclosure also relates to an inflatable instrument packer element, comprising an inflatable section extending between a first end and a second longitudinal end, the inflatable section made of an elastomeric material reinforced with a plurality of reinforcement cables and operable to be inflated within a borehole. Each reinforcement cable extends essentially along a longitudinal axis of the packer element. The packer element also comprises a fiber optic sensor set in the elastomeric material between the first and second longitudinal ends and extending along a length of one of the reinforcement cable.

BRIEF DESCRIPTION OF THE DRAWINGS

Certain embodiments of the invention are described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current invention.

DETAILED DESCRIPTION

Figure 1:
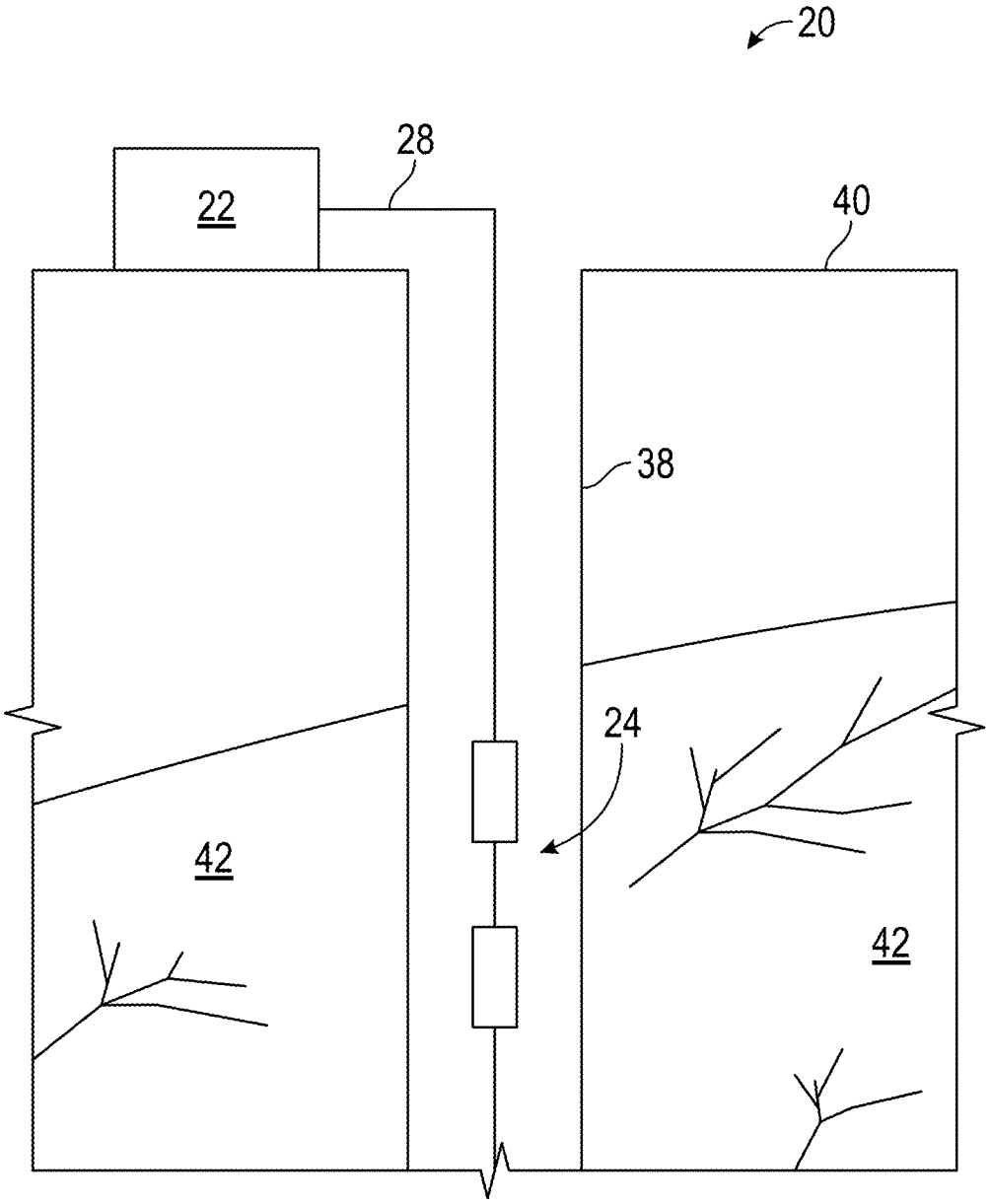
FIG. 1 is a schematic representation of a dual packer assembly system deployed in a borehole, in accordance with an embodiment.

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

Fiber optic monitoring systems have been used to image the characteristics of an earth formation. Such systems, particularly distributed fiber-optic monitoring systems, employ an optical source (e.g., a laser) to generate pulses of optical energy to launch into an optical fiber that is deployed in a region of interest (e.g., in a wellbore). As the launched pulses travel along the length of the optical fiber, small imperfections in the fiber reflect a portion of the pulses, generating backscatter. When the fiber is subjected to strain (such as from vibration or acoustic signals propagating through the region of interest or deformation of the borehole that it contacts), the distances between the imperfections change. Consequently, the backscattered light also changes. By monitoring the changes in the backscatter light generated by the fiber in response to interrogating pulses launched by the optical source into the fiber, it is possible to determine the dynamic strain, or vibration, experienced by the fiber. The measured strain or vibration then can be used to derive information about various parameters of interest, such as characteristics of a surrounding earth formation.

One type of fiber optic monitoring system is referred to as a Distributed Vibration Sensing (DVS) system, a heterodyne Distributed Vibration System (hDVS) or, alternatively, a Distributed Acoustic Sensing (DAS) system. For convenience, DVS, hDVS and DAS systems are generally referred to herein as a DVS system.

In DVS systems, a narrowband laser is generally used as an optical source to generate interrogating pulses of light to launch into the sensing fiber. The use of a narrowband laser results in interference between backscatter returned from different parts of the fiber that are occupied by a probe pulse at any one time. This is a form of multi-path interference and gives rise to a speckle-like signal in one dimension (along the axis of the fiber), sometimes referred to as coherent Rayleigh noise or coherent backscatter. The term "phase-OTDR (optical time domain reflectometry)" also is used in this context. The interference modulates both the intensity and the phase of the backscattered light and minute (<<wavelength) changes in the length of a section of fiber are sufficient to radically alter the value of the amplitude and phase. Consequently, the technique can be useful for detecting small changes in strain.

Sampling or injection into a borehole to evaluate an earth formation requires the use of packers to isolate a zone or interval of interest. Characteristics of the earth formation can be determined using pressure measurements and/or very high accuracy acoustic or micro-seismic measurements using DVS techniques.

Referring now to FIG. 1, an example of a well system 20 comprising an interrogation and acquisition system 22 and a dual packer assembly 24 is illustrated. The system 22 is coupled to one or more optical fibers used to obtain data, such as strain or pressure data. The optical fiber(s) can be in the form of a cable embedded in a wireline cable 28. In this example, the system 22 includes a detector 30 for monitoring backscatter signals and acquiring data therefrom (see FIG. 11). Additionally, the system 22 includes a suitable optical source 32 located at surface 40, e.g., a narrowband laser, to establish interference between backscatter signals returned from different parts of the fiber 26. The interrogation and acquisition system 22 also can be part of or coupled with a processor-based control system (e.g., system 60) used to process the collected data. In FIG. 1, the packer assembly 24, which includes spaced apart inflatable packer element 50 (shown on FIG. 2), is conveyed by the wireline cable 28 into the borehole 38 drilled in a formation 42. The inflatable packer elements 50 generally are made of a cable reinforced elastomeric material that can withstand high inflation pressures (e.g., up to 830 bar). In this embodiment, the packer assembly 24 comprises two packer elements 50 but it may include only one packer element or more than two spaced apart packer elements.

Figure 2:
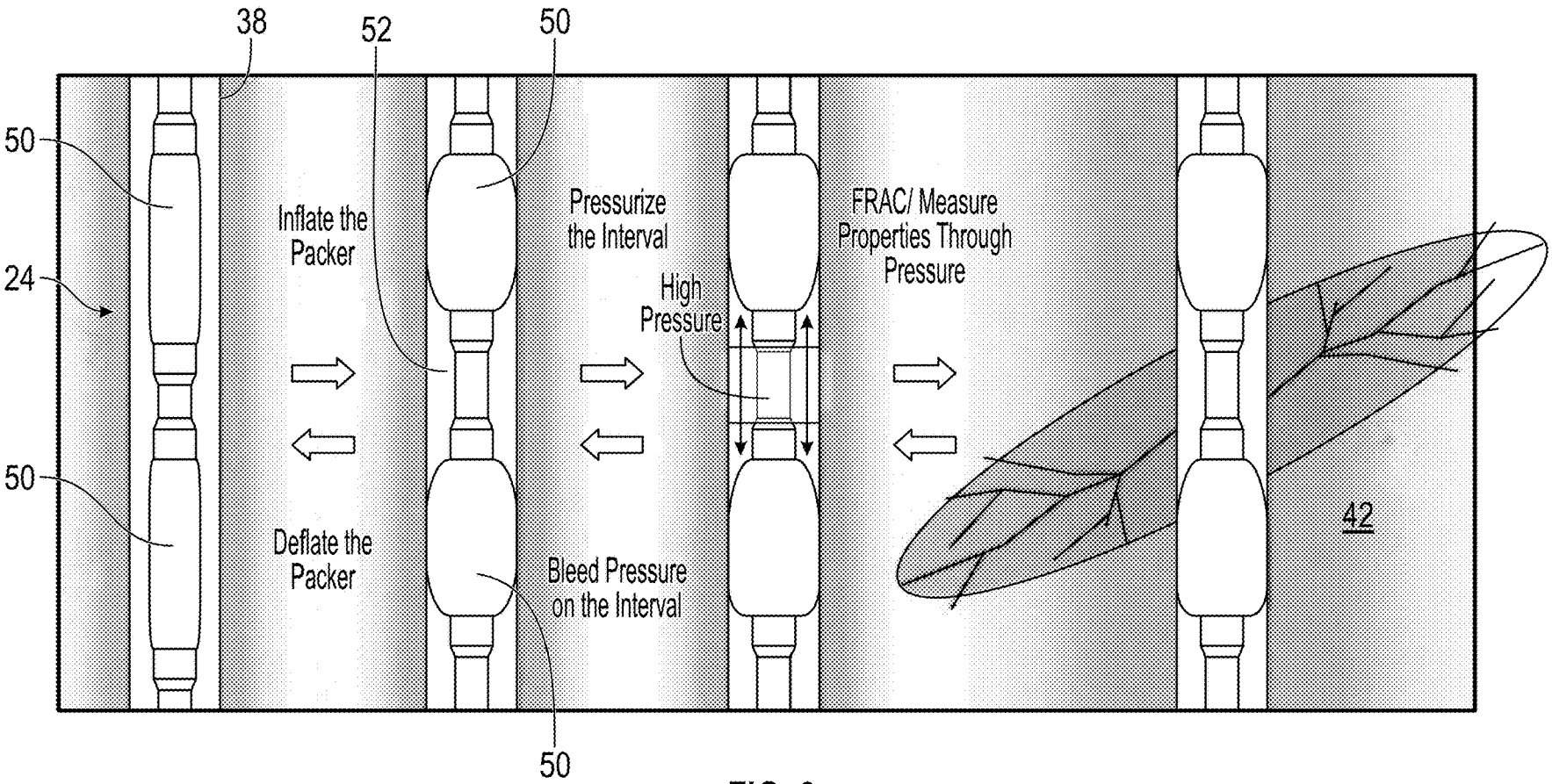
FIG. 2 shows use of a dual packer assembly to monitor characteristics of a formation during a fracturing operation, in accordance with an embodiment.

The diagram of FIG. 2 illustrates a sequence of steps in which the packer assembly 24 is conveyed into the borehole 38 to an interval of interest 52 so that the surrounding formation 42 can be hydraulically fractured. In this example, optical fibers that can be used as sensors that are set in the packer elements 50 of packer assembly 24 (i.e., the packer elements 50 are instrumented) so that characteristics of the formation can be evaluated. In the diagram of FIG. 2, the borehole 38 has been drilled so that it extends from the surface 40 and penetrates the formation 42, which is a hydrocarbon producing formation. The packers are introduced in the borehole in a deflated configuration in order to easily slide into the borehole. Moving to the right in the diagram, when at the desired location within the borehole 38, the instrumented packer elements 50 are inflated so that they cooperate to seal or isolate the interval of interest 52 of the borehole 38. Moving again to the right in FIG. 2, the interval 52 is then pressurized. As shown, pressurization of the interval 52 subjects the packer elements 50 to differential pressure that further deforms the inflatable bodies, and ultimately the earth formation 42 in the region of the pressurized interval 52 is hydraulically fractured (rightmost figure).

Moving back to the left in the diagram of FIG. 2, after the formation 42 is hydraulically fractured, the pressure is bled from the interval 52. As the differential pressure experienced by the packer elements 50 decreases, the packer elements 50 revert to their previous inflated shape. Finally, the packer elements 50 are deflated so that the workstring can be moved within the borehole 38.

In embodiments described herein, the optical fiber(s) 26 are set on or inserted in the packer elements 50 in order to provide measurements of pressure, deformation and/or to detect events such as acoustic events which can be used to evaluate the earth formation 42 surrounding the interval of interest 52. The inflatable packer elements 50 sustain large amounts of deformation as a result of inflation, pressurization of the interval, depressurization of the interval and then deflation of the packer elements. Accordingly, the low-elongation optical fibers 26 are packaged within the packer elements 50 in a manner that will not damage the fibers 26.

Figure 3:
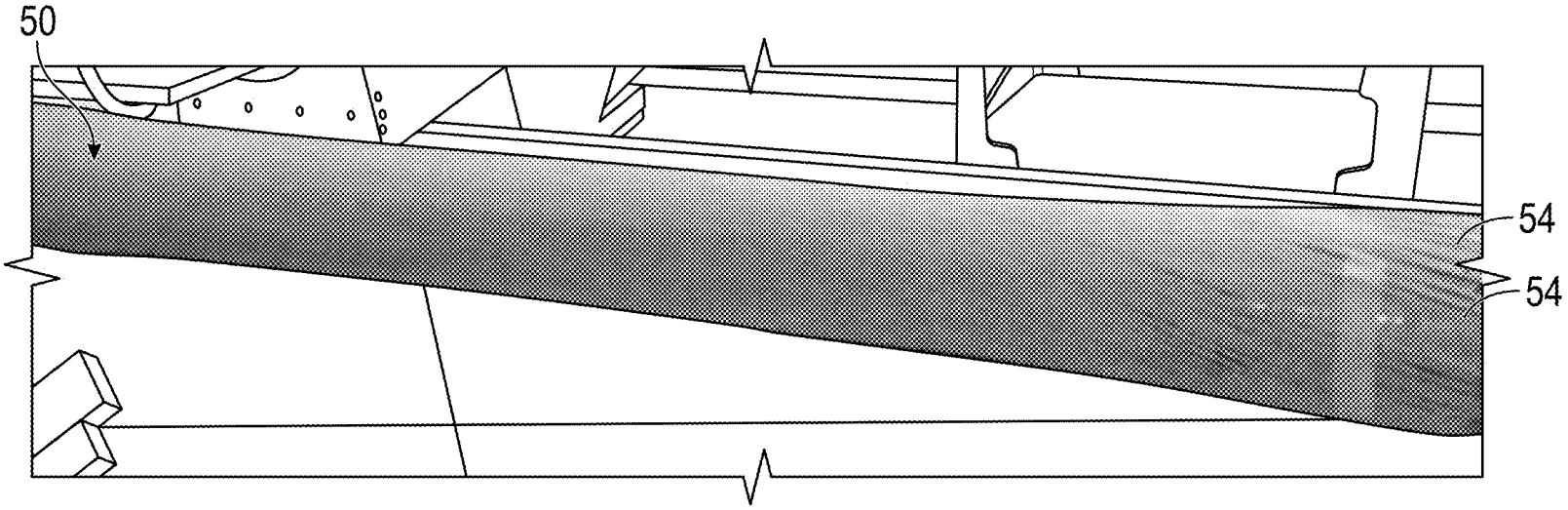
FIG. 3 shows an example of an inflatable packer element during manufacturing, in accordance with an embodiment.

The packer elements 50 are made of an elastomeric material 58 (FIG. 4) that is reinforced with cables 54 so that the elements 50 can withstand the inflation pressure and differential pressure encountered when the interval is pressurized. An example of such a cable reinforcement is shown in FIG. 3 which illustrates a packer element 50 with multiple cables 54 extending along and wrapping about the longitudinal axis of the packer element 50. The reinforcement cables extend essentially along the longitudinal axis of the packer, i.e. form an angle of less than 45° with the packer longitudinal axis. In embodiments, this cable structure can be used to integrate optical fibers 26 (FIG. 4) within the packer elements 50 to form an instrumented packer element.

Figure 4:
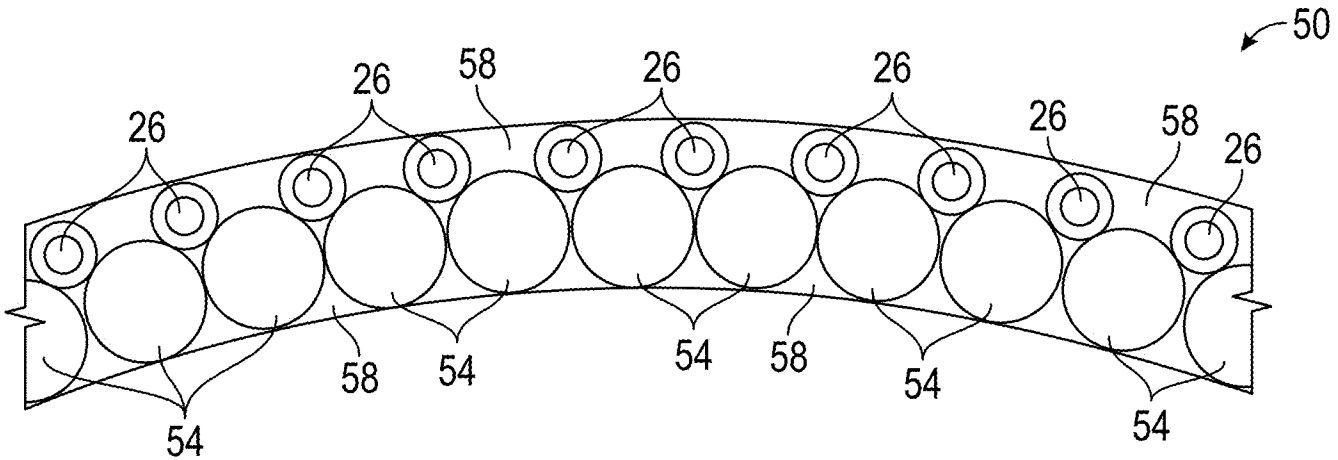
FIG. 4 is a partial cross-sectional view of a cable reinforced elastomeric material of an inflatable packer element with optical fibers set therein, in accordance with an embodiment.

For example, as shown in the partial cross-sectional view in FIG. 4 of an instrumented inflatable packer element 50, one or more optical fibers 26 can be laid down with the same orientation as the reinforcing cables 54 of the element 50, such as by placing an optical fiber 26 in the crevice formed between two adjacent cables 54. Such an arrangement can provide the protection needed for the optical fibers 26 by matching the fibers 26 with the elongation of the cables 54 within the range of expected pressure experienced by the packer element 50.

In embodiments, the optical fiber 26 can be laid down in a position where it can slide relative to the cables 54 so that the measurements obtained from the fiber 26 provide information about the stretch of the cables 54. In embodiments, the optical fiber 26 can be laid so that is does not move relative to the cables 54. In such arrangements, the optical fiber 26 can be used to provide information about the pressure received by the elastomeric material 58 of the packer element 50 in the location where the fiber 26 is submerged. In embodiments, and depending on the type of measurement of interest, one or more optical fibers 26 can be located over the outermost layer of the packer element 50, under the innermost layer of the packer element 50, or in between layers within a multilayer packer element 50 so that the fiber(s) 26 can couple with the environment of interest (e.g., the cables 54 or the elastomer 58). In embodiments, the intrinsic damping characteristics of the elastomer 58 can be used to isolate (or decouple) the fiber(s) 26 from parasitic signals, such as acoustic noise coming from a support structure of the packer element 50. In yet further embodiments, the packer element 50 can include a fully dedicated layer to house the measurement fiber(s) 26.

Movement of the optical fiber(s) 26 with the instrumented packer element 50 can be facilitated through the use of lubricants, such as a PTFE-based material in solid or liquid-to-viscous form. Or, movement of fibers 26 can be facilitated by appropriately managing the distance between the cables 54 and the fibers 26 to allow for relative motion.

In embodiments, one fiber 26 can be inserted (or laid down) in the instrumented packer element 50. Or multiple fibers 26 can be inserted for redundancy or for higher accuracy or to provide different types of information. In embodiments, the same fiber 26 that is inserted in the packer element 50 also can be looped around at each end of the packer element 50 in a single layer or in multiple layers. Looping the fiber 26 in this manner can provide appropriate stress relief and pig tails within or outside of the elastomer 58 to help avoid damage to the fiber 26, avoid gathering noise from unwanted sources or similarly provide the required separation between dissociated measurements. Yet further, the packer element 50 can include appropriate connection structures to couple/decouple the packer element 50 to/from the surface acquisition system 22 for the transfer of data. In embodiments, data can be transferred to the surface system 22 in real time or at a later time.

Figure 5:
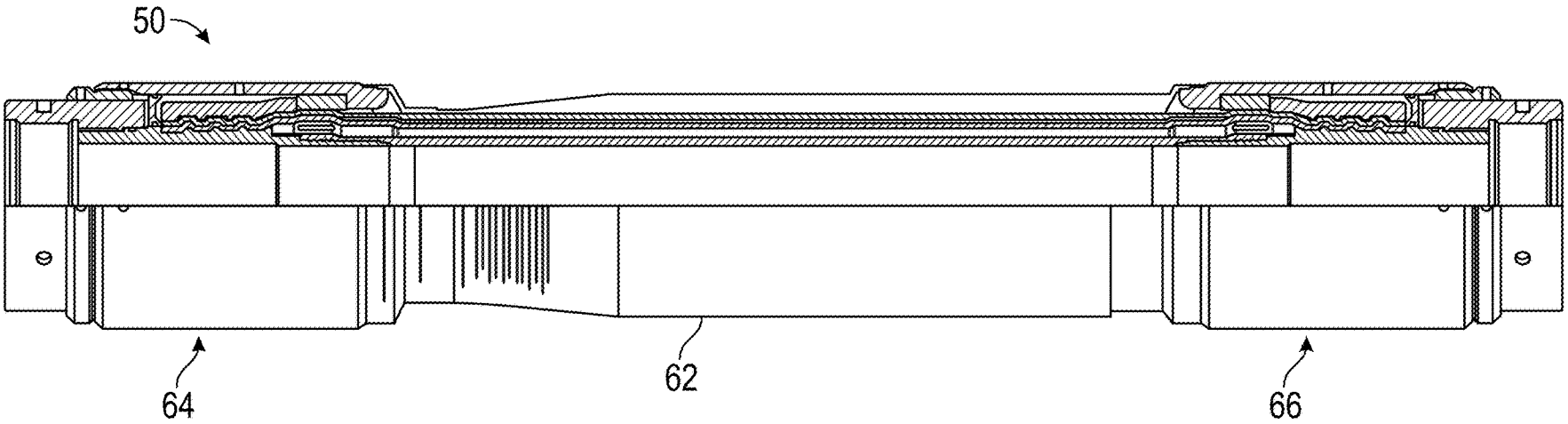
FIG. 5 schematically illustrates an instrumented inflatable packer element in partial cross section, in accordance with an embodiment.
Figure 6:
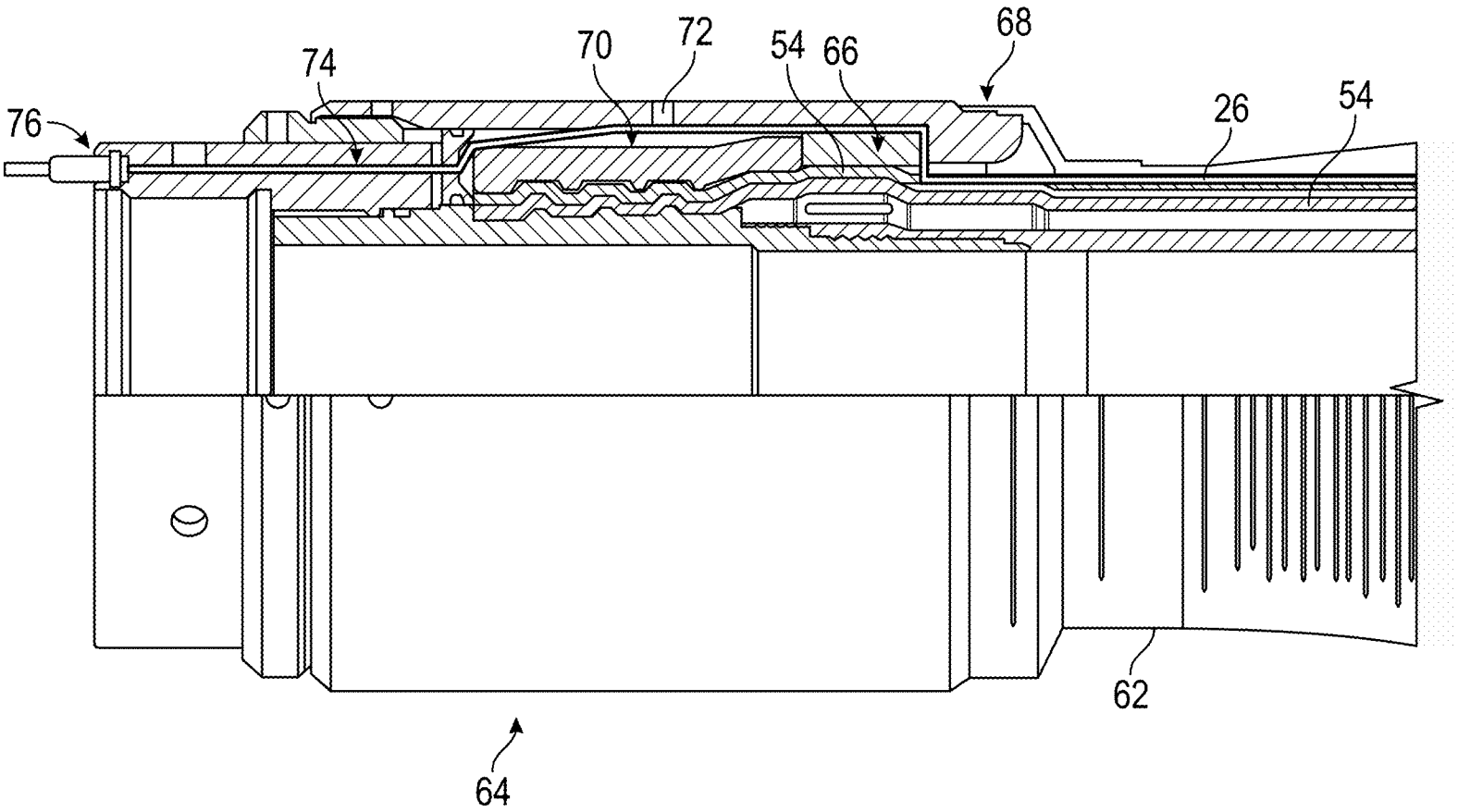
FIG. 6 is a close up view of an end of the instrumented inflatable packer element of FIG. 5, in accordance with an embodiment.
Figure 7A:
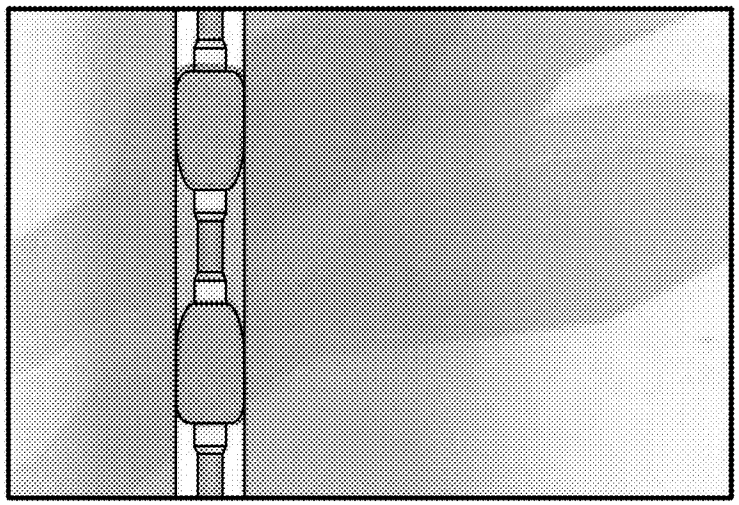
FIGS. 7A-7D illustrate another example of the use of a dual packer assembly with instrumented inflatable packer elements to measure characteristics of a formation during a fracturing operation, in accordance with an embodiment.
Figure 7B:
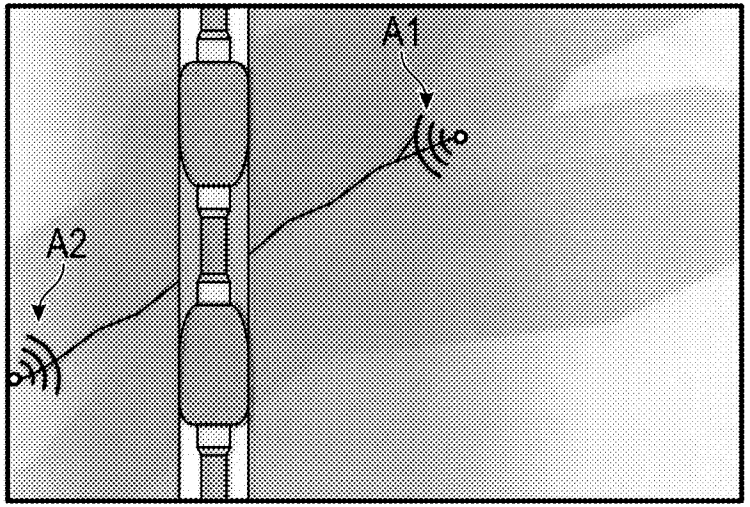
Figure 7C:
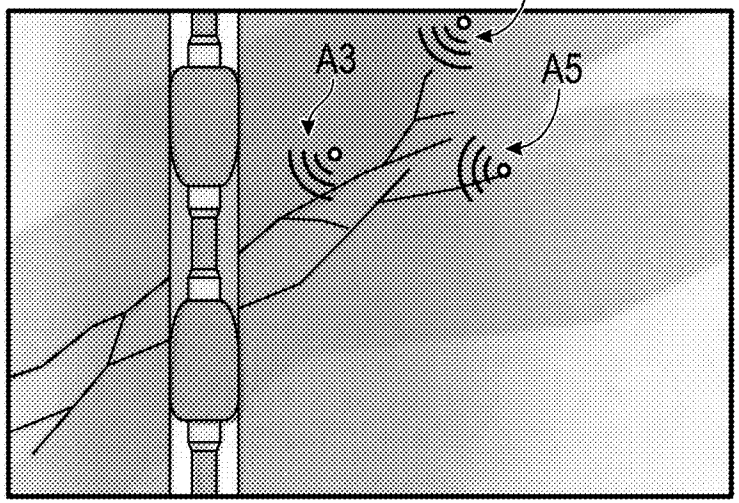
Figure 7D:
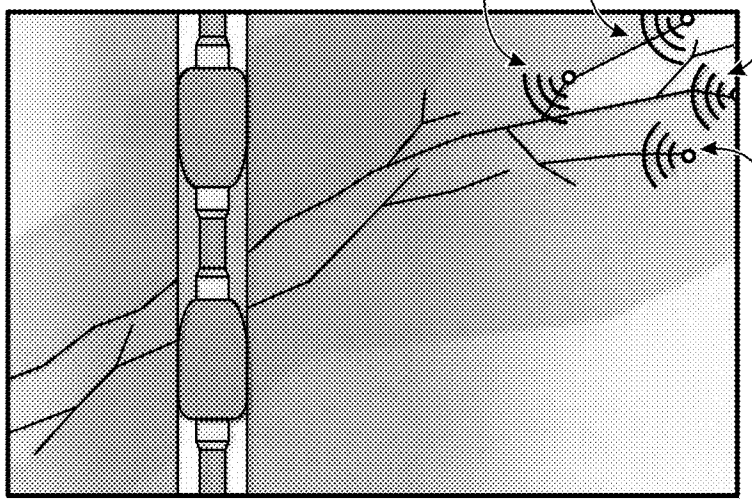

An example of one embodiment of an instrumented inflatable packer element 50 is illustrated in FIGS. 5 and 6. FIG. 5 shows a partial cross-sectional view of the packer element 50 where a cable reinforced elastomer inflatable section 62 extends between a first end 64 and a second end 66. The reinforced inflatable section 62 includes an optical fiber 26 set between reinforcement cables 54. Although only one fiber 26 is shown on FIG. 6, it should be understood that multiple fibers 26 and/or multiple portions of a fiber can be set in the reinforced inflatable section 62. FIG. 6 is a close up view of the end 64 of the packer element 50 of FIG. 5. At the end 64, the optical fiber 26 is set in a manner (as will be described below) so that the fiber 26 is not stressed by the elongation of the inflatable section 62 due to inflation and pressurization of the interval.

As shown in FIGS. 5 and 6, the optical fiber 26 is set between the reinforcement cables 54 along the length of the inflatable section 62 up to a crimping region 66 where the reinforcement cables 54 and elastomeric material are crimped on an inner mandrel. As shown, the fiber 26 exits the layer of cables 54 just before the crimping region 66 in order to protect the fiber 26 from mechanical damage caused by crimping. As best seen in FIG. 6, the fiber 26 is routed above a crimped skirt in region 66 and below an injection skirt 68. As an example, the fiber 26 can be routed in a groove formed in the crimped skirt and/or injection skirt so that the fiber 26 is not pinched between the skirts when pressure is applied. In the embodiment shown, the fiber 26 is routed through an epoxy region 70 in which epoxy resin (or other appropriate plastic material) is injected through a port 72 to ensure there is no void between sealed mechanical parts and to ensure that there is no stress due to hydrostatic pressure. From the epoxy region 70, the fiber 26 is routed through an end connector 74 and is welded to a feedthrough 76. The routing of the fiber 26 at the other end 66 of the packer element 50 is implemented in the same manner as shown in FIG. 6 for end 64.

The dual packer assembly 24 with inflatable instrumented packer elements 50 is particularly suited for micro-seismic acquisition of events such as acoustic events in real time during hydraulic fracturing of a formation (i.e., as the event are triggered by hydraulic pressure and not as a post-event due to the relaxation from the formation). The assembly 24 provides acoustic isolation from the inner support structure of the inflatable packer elements 50 by use of the intrinsic properties of the elastomeric material 58 itself and also by dissipation of parasitic acoustic signals within the structure of the packer element 50 that is made of the multiple layers of semi-rigid (e.g., cable 54) and deformable (elastomer 58) elements.

FIGS. 7A-7D illustrate the use of the dual packer assembly 24 with instrumented packer elements 50 for acoustic monitoring of hydraulic fracturing of the formation 42. As shown in FIGS. 7A-7D, the packer elements 50 work together to isolate an injection zone 52 for a hydraulic fracturing operation. Therefore, the dual packer assembly 24 provides an ideal location with appropriate apertures on both sides of the event being monitored. FIGS. 7A-7D each shows different successive stages of the fracturing operation (FIG. 7A before the formation is fractured, FIG. 7B after the first fracture is formed, FIGS. 7C and 7D after further fractures are formed). The acoustic events, happening at the formation of fractures are also represented on the FIGS. 7B-7D (A1-A2 on FIG. 7B, A3-A5 on FIG. 7C and A6-A9 on FIG. 7D). Waves generated by these acoustic events propagate to the dual packer assembly and are received by the fiber optic sensor at a certain time dependent on the occurring time of each of the acoustic event in the formation and distance between location of occurrence of acoustic event and fiber optic sensors.

Figure 9:
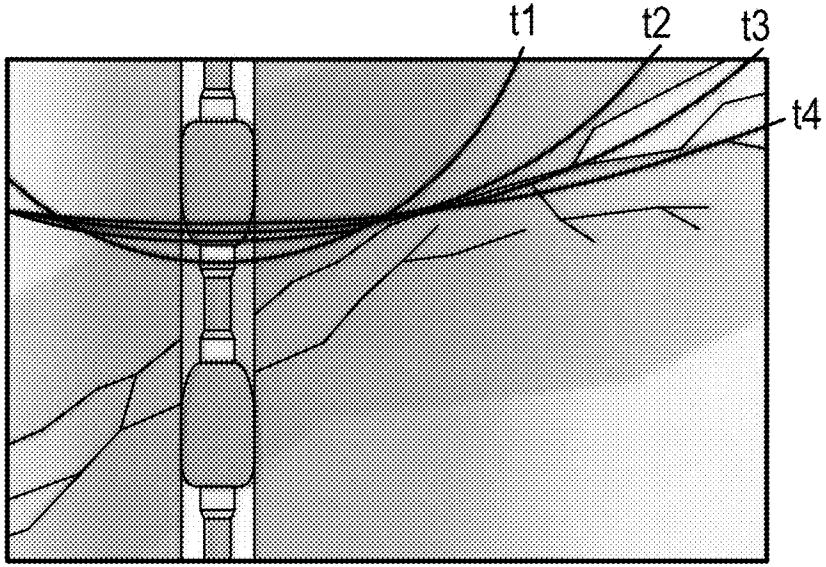
FIG. 9 illustrate further information about the formation that can be derived using instrumented inflatable packer elements, in accordance with an embodiment.
Figure 8:
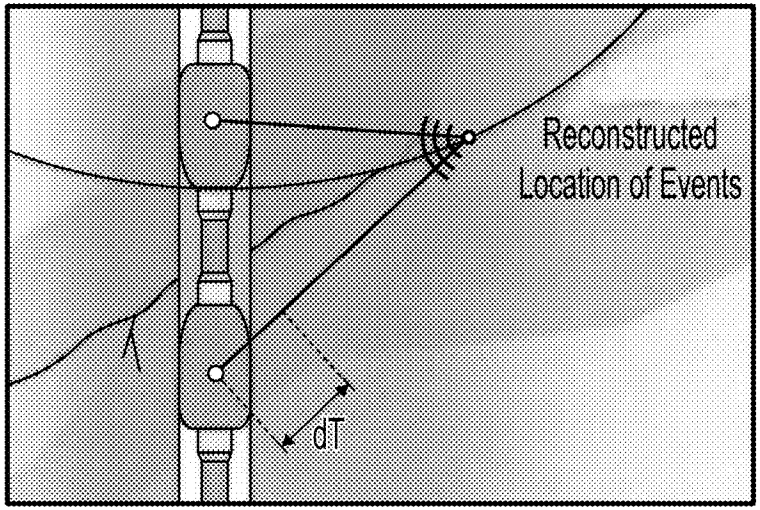
FIG. 8 illustrates the use of a two-point measurement technique using instrumented inflatable packer elements to locate an event resulting from a fracturing operation, in accordance with an embodiment.

The two-point measurement (with the two fiber optic sensors) can provide a travel time offset dT as represented on FIG. 8 and, with information of the acoustic velocity, a hyperboloid surface on which the acoustic event is located, as shown on FIG. 9. Trends can be plotted against time (t1, t2, t3, t4) to reveal any migration of acoustic events, possibly associated to fracture tip, pore pressure or fluid changes through the formation 42. Accumulating data at different times, it is possible to define the envelope within which the fractures in the formation 42 have occurred. This may be done in real-time, and is sufficient for monitoring the fracturing efficiency, which may be beneficial if one wants to make sure, e.g., it is not going above or below the packers and break the hydraulic seal, leading to early termination of job In other applications, the two-point measurement can provide much greater value if coupled with at least one additional measurement point to determine the depth of the acoustic event within the reservoir. The correlation would have azimuthal uncertainty but would further reveal fracture plane orientation (i.e., the absolute value of the tilt from the median plane).

Figure 10:
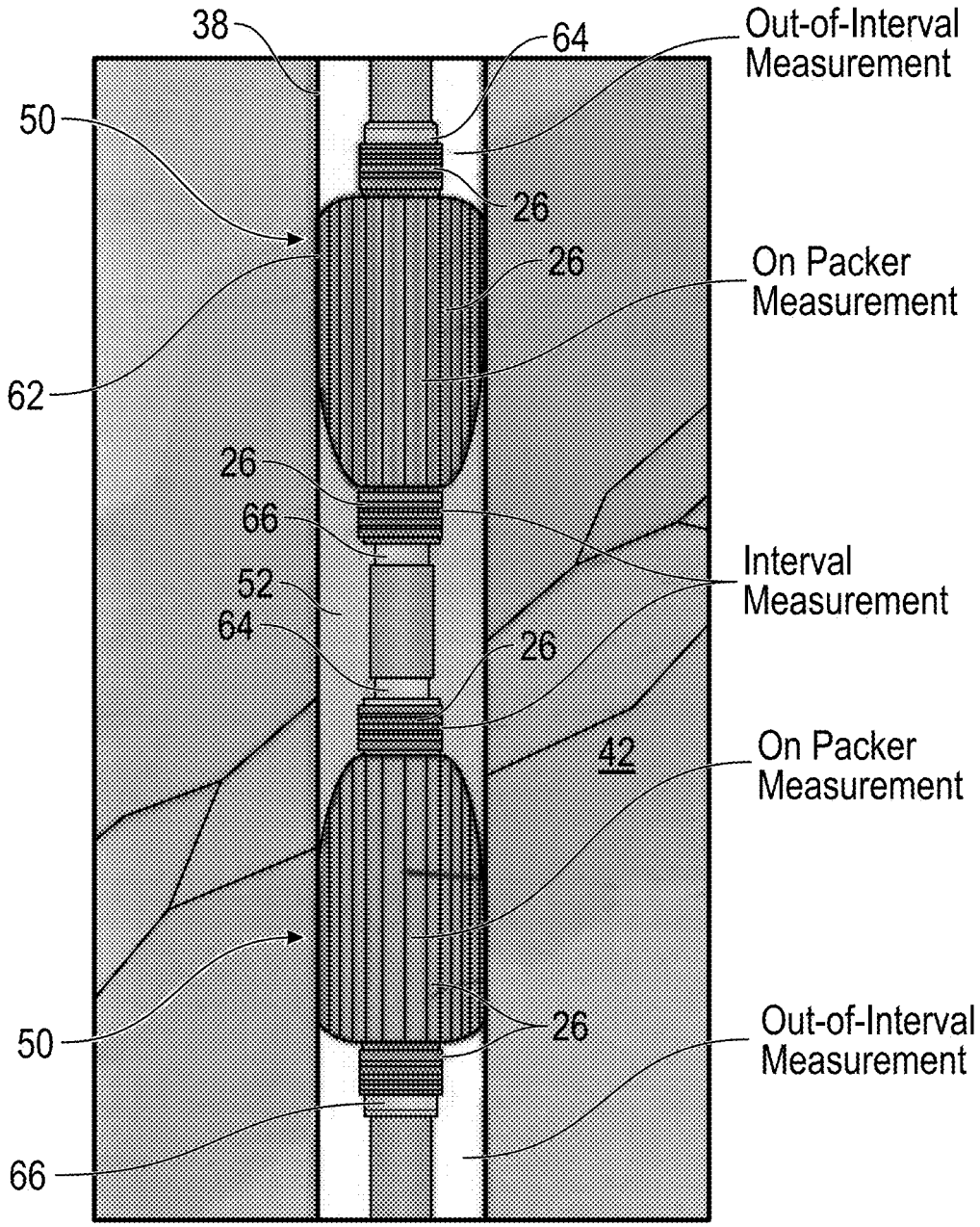
FIG. 10 illustrates a dual packer assembly with instrumented inflatable packer elements that include additional sensors on the ends of the elements, in accordance with an embodiment.

To that end, in certain embodiments and as shown in FIG. 10, two-point measurements obtained from a dual packer assembly 24 can be combined with preexisting reservoir models and/or other real-time measurements, such as the injected volume of fluid or the magnitude of acoustic event (available in the pressure data). Together, this information can provide an estimate in real time of the location of acoustic events, possibly associated to fracture tip, pore pressure or fluid changes within the reservoir.

In other embodiments, dual packer assembly 24 can include multiple sensor elements (e.g., fiber optic-based sensor elements) to form a micro-seismic array near the injection point of fracturing fluid into the formation. In such embodiments, some of the sensor elements can be instrumented packer elements 50 used for both their sealing capability and as a sensor. Other embodiments of the sensor elements are used only as sensors. An arrangement using multiple sensor elements to form an array would enhance the accuracy of the formation mapping.

For example, a third measurement point can be obtained by extending the length of the fiber 26 outside the inflatable section 62 of the packer element 50 and exposing it to the injected fluid within the interval 52. When acquired and processed with the same system (i.e., the same system clock), the third acoustic measurement allows for triangularization and eventually correlation to the depth of the acoustic event with the reservoir using the injection fluid velocity. Given azimuthal uncertainty, the events may be placed on circles.

As an example, in the embodiment illustrated in FIG. 10, each instrumented packer element 50 can be provided with sections of coiled fiber 26 on at least one of ends 64 and 66 to provide the third measurement point within the interval 52. In embodiments, the coiled section 26 can be located on both ends 64 and 66 of the packer element 50 for redundancy, for practicality of use (symmetry), or as additional sensors isolated from the reservoir by the packer elements 50 themselves. The sensors located outside the interval 52 can provide information of the acoustic noise on the support structure of the packer element 50 for decorrelation on the sensor measurement located in the interval 52 in situations in which there is high noise. In situations where there is only limited noise on the support structure, the sensors outside the interval 52 can simply provide additional data to process a more complex acoustic path through the formation 42 first and then through mud in the borehole 38.

Figure 11:
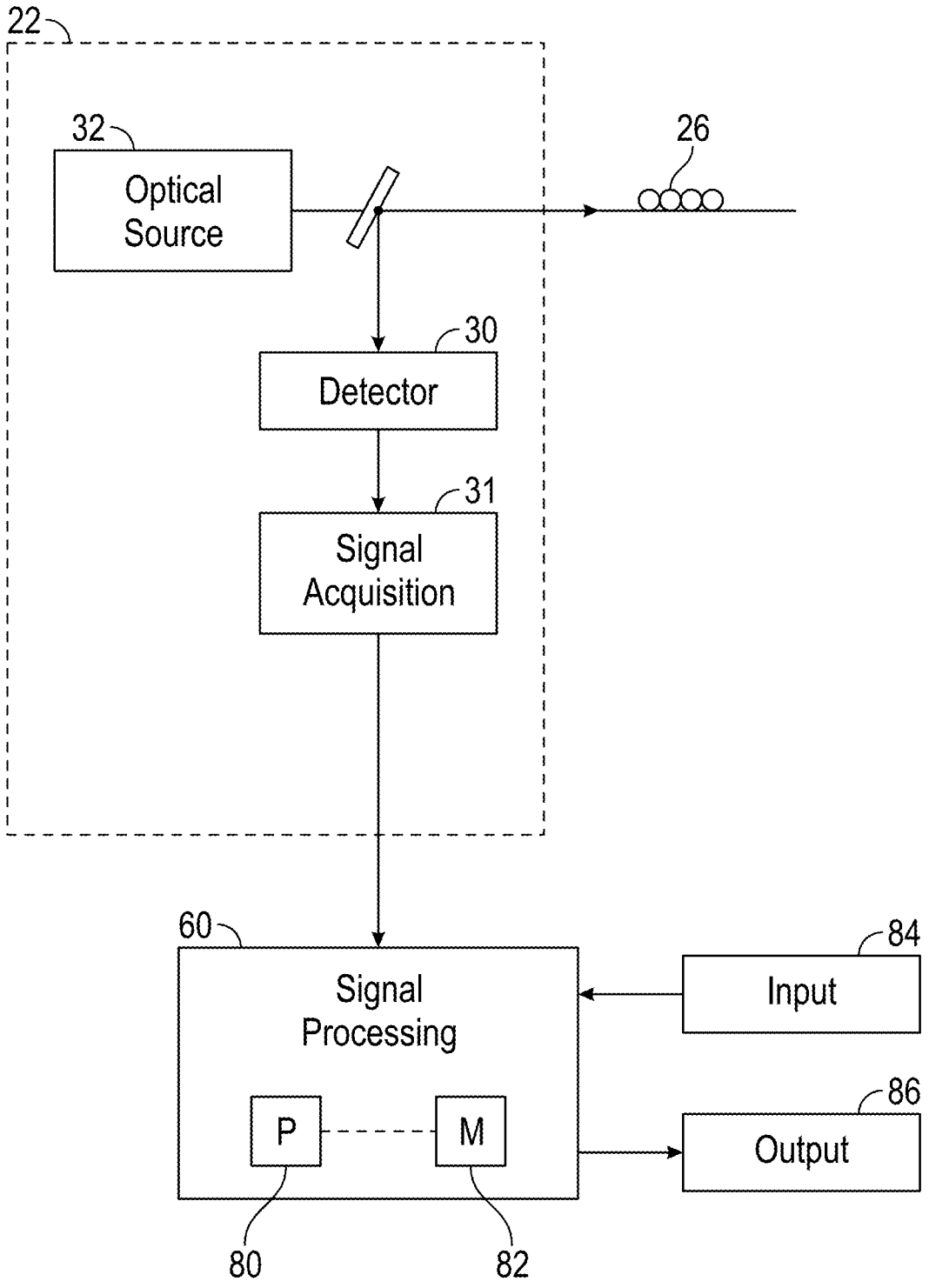
FIG. 11 is a schematic representation of a surface acquisition system and signal processing system to acquire and analyze the data obtained from instrumented inflatable packer elements, in accordance with an embodiment.

The data obtained by the surface system 22 can be processed according to various methods, and can be processed in whole or in part on a processor-based control system 60. An example of the processing system 60 is illustrated in FIG. 11 and can be in the form of a computer-based system having a processor 80, e.g., a central processing unit (CPU). In embodiments, the processor 80 can be part of the system 22 or can be operatively employed to intake data from system 22 and to process the data. Depending on the application, the processing of data may involve the running of various models/algorithms related to evaluation of signal data, e.g., backscatter data, received from the sensing fiber 26. By way of example, the data can be processed to determine characteristics of the formation 42 resulting from the hydraulic fracturing operation.

The processor 80 can be operatively coupled with a memory 82, an input device 84, and an output device 86. Input device 84 can comprise a variety of devices, such as a keyboard, mouse, voice recognition unit, touchscreen, other input devices, or combinations of such devices. Output device 86 can comprise a visual and/or audio output device, such as a computer display, monitor, or other display medium having a graphical user interface. Additionally, the processing can be done on a single device or multiple devices on location, away from the well location, or with some devices on location and other devices located remotely. Once the desired signal processing has been conducted to evaluate the vibrations/strains for evaluating the formation, the processed data, results, analysis, and/or recommendations can be displayed on output 86 and/or stored in memory 82 so that further actions can be taken if desired.

Figure 12:
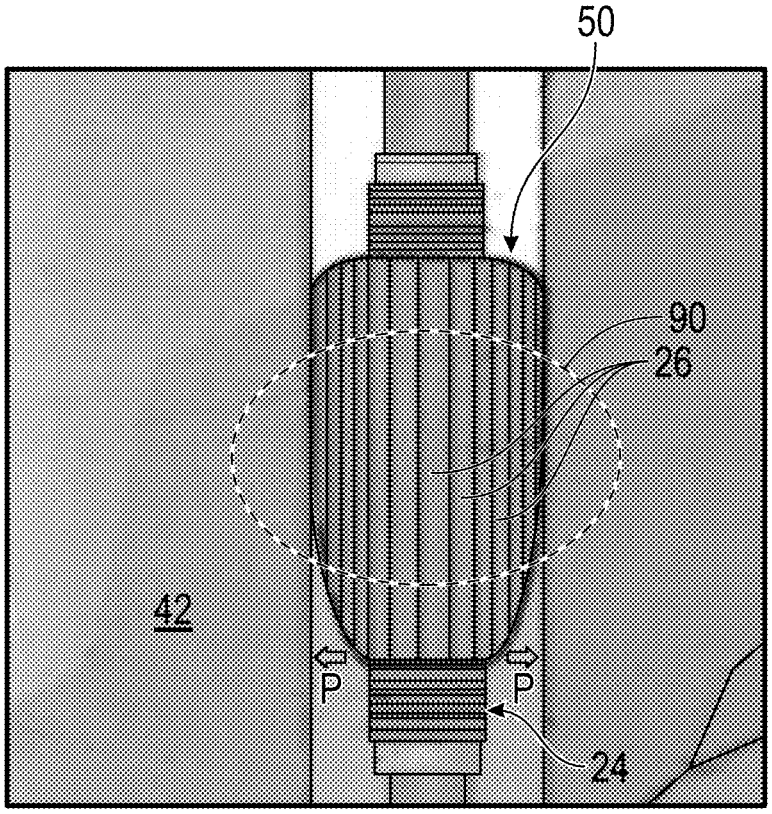
FIG. 12 schematically illustrates an instrumented inflatable packer element in partial cross section, in accordance with an embodiment

The instrumented packer according to the disclosure has been described here with reference to a hydraulic fracturing application. However, in other embodiments, a single packer used for a stress test may be instrumented as it has been described with reference to FIGS. 3-6. A stress test is a well-known test shown on FIG. 12 in which a packer element 50 of a packer assembly 24 is inflated and generates pressure P on the formation until it generates a fracture in the subterranean formation 42 at the packer depth (in the fracturing zone 90). The packer is then deflated, decreasing pressure P applying onto the formation until fracture closure and may be inflated/deflated again to open/close the created fracture (also known as primary fracture pair) or further inflate to initiate additional fractures (also known secondary fracture pair perpendicular to the primary fracture pair), which can later be open/closed by inflation/deflation for stress magnitude determination. Such stress test procedure is for instance disclosed in the publication "*Laboratory and field verification of a new approach to stress measurements using a dilatometer tool*", T. Ito, A. Sato, K. Hayashi, International Journal of Rock Mechanics & Mining Sciences 38 (2001) 1173-1184 herein incorporated by reference. In this configuration the fiber deformation may be sensed with the DVS equipment in order to detect any deformation event of the fiber (ie strains are measured) generated by a fracture opening and/or closure (ie borehole deformation events), determining if fracture opening and/or closure has occurred and deriving formation in-situ stress.

Figure 13:
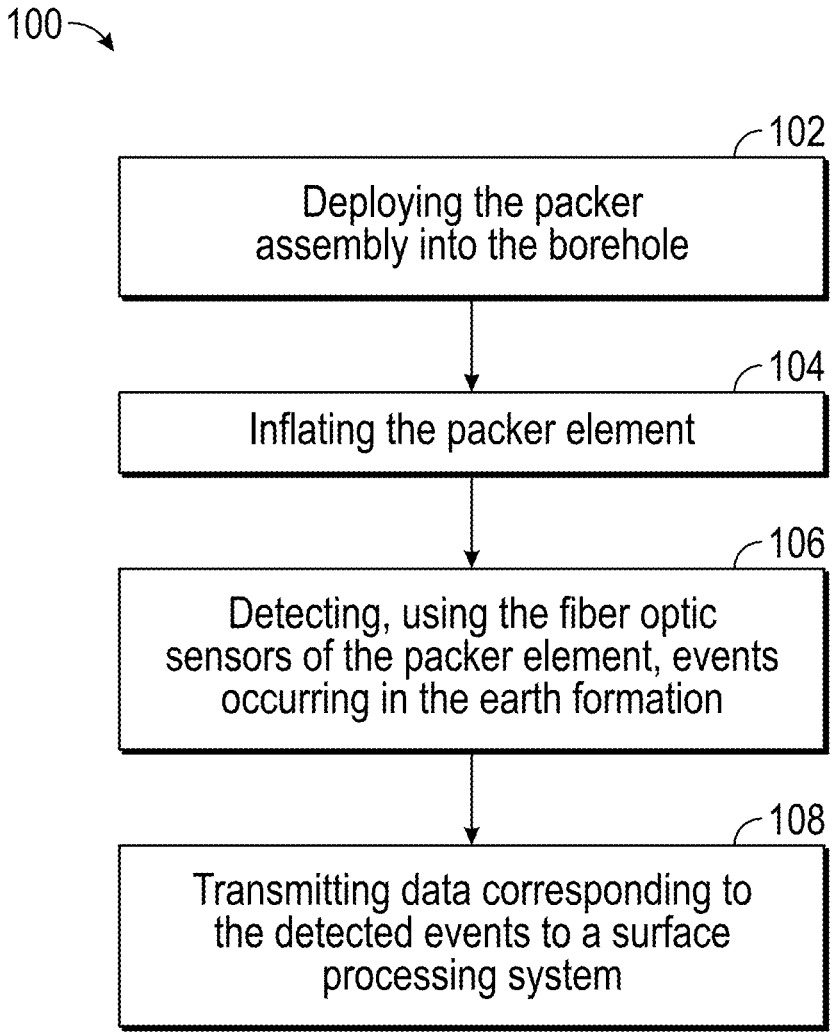
FIG. 13 is a flowchart illustrating a method according to an embodiment of the disclosure.

A flowchart showing a method according to the disclosure is shown on FIG. 13. The flowchart of FIG. 13 illustrates a sequence of steps in which the packer assembly 24 comprising at least one packer element is conveyed into the borehole 38 to an interval of interest (for instance, so that the hydraulic fracturing or stress test may be performed). In this example, optical fibers that can be used as sensors that are set in the packer element 50 (i.e., the packer elements 50 is instrumented) so that characteristics of the formation (such as the in-situ stress in case of a stress test or fracturing efficiency) can be evaluated. The borehole 38 has been drilled so that it extends from the surface 40 and penetrates the formation 42, which is a hydrocarbon producing formation. The packer assembly is deployed 102 in the borehole in a deflated configuration in order to easily slide into the borehole. When at the desired location within the borehole 38, the at least one instrumented packer element 50 is inflated 104. When the application is a stress test, the inflated packer is inflated to apply pressure on the formation 42 at the location of the packer and deforms the formation (the borehole wall). In particular, as explained below, the packer may be inflated so that at least fractures appear in the borehole wall. When the application is hydraulic fracture, the packer assembly includes a dual packer assembly and the packer are inflated in order to seal an interval of interest.

The method then comprises detecting 106, using the fiber optic sensors of the or each packer elements 50, events occurring in the earth formation. In the case of the stress test, the events are deformation events of the borehole (such as fracture opening) and in the hydraulic fracturing configuration, the events are acoustic events. Optionally the method may include further inflating/deflating the packer elements and detecting the events during these further inflations/deflations, especially in the stress test configuration as discussed above. The method then comprises transmitting 108 data corresponding to the detected events to a surface processing system and optionally determining a characteristic of the formation based on the data via the surface processing system. For instance, for a stress test, the in-situ stress of the formation may be determined while for the hydraulic fracturing configuration, a characteristic of the formation related to the fracturing operation such as fracturing efficiency or location of the fractures, fracture type or fracture plan orientation.

Other events may be detected and/or localized using the instrumented packer as set forth in the disclosure.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

The disclosure relates to a method of evaluating characteristics of an earth formation, comprising deploying a packer assembly in a borehole penetrating an earth formation, the packer assembly comprising an instrumented inflatable packer element including fiber optic sensors; inflating the instrumented inflatable packer elements; detecting, using the fiber optic sensors, events occurring in the earth formation; and transmitting data corresponding to the detected events to a surface processing system.

In an embodiment, transmitting comprises transmitting the data in real time.

In an embodiment, the fiber optic sensors comprise optical fibers set in the instrumented inflatable packer elements. In particular, the fiber optic sensors may comprise distributed fiber optic sensors. In a particular embodiment, the instrumented inflatable packer element comprises an inflatable section extending between a first end and a second end, the inflatable section made of an elastomeric material reinforced with a plurality of cables, wherein the optical fiber is set within the elastomeric material. In such case, the optical fiber may be set in the elastomeric material between adjacent cables.

In a further embodiment, the fiber optic sensors further comprise a coil of optical fiber disposed at least one of the first and second ends.

In an embodiment, the method may include determining at least one characteristic of the formation based on the detected events. Determining at least a characteristic of the formation may include determining at least one of an in-situ stress of the formation, of a fracturing efficiency, of a fracture plane orientation.

In an embodiment, the method includes deforming the formation contacting the packer, where the events are detected while the packer is inflated and/or deflated. In such case, the detected events are deformation events and the method may determining an in-situ stress of the formation based on the detected events.

In another embodiment, deploying may comprise deploying a dual packer assembly in the borehole, the packer assembly comprising a first and second instrumented inflatable packer elements; inflating comprises inflating the first and second packer elements, the method further including pressurizing the sealed interval of interest to hydraulically fracture the formation, wherein the events are detected while the formation is hydraulically fractured. In such case, the detected events are acoustic events and the method may determine at least one of a fracturing efficiency and of a fracture plane orientation based on the detected events.

In an embodiment, the event is an acoustic and/or a deformation event.

The disclosure also related to an instrumented packer system for evaluating an earth formation, comprising at least a packer assembly deployed in a borehole extending from an earth surface into a formation, the at least one packer assembly comprising an inflatable section extending between a first end and a second longitudinal end, the inflatable section made of an elastomeric material reinforced with a plurality of reinforcement cables and operable within a borehole; wherein each reinforcement cable extends essentially along a longitudinal axis of the packer element, and a fiber optic sensor set in the elastomeric material between the first and second longitudinal ends and extending along a length of one of the reinforcement cable, the fiber optic sensor configured to respond to events occurring within a region of interest. The system also includes an optical source to launch optical pulses into the distributed fiber optic sensor while the acoustic signals are incident on the fiber optic sensor; and a data acquisition system coupled to the distributed fiber optic sensor to detect backscattered optical signals generated by the distributed fiber optic sensor in response the launched optical pulses to determine characteristics of the formation.

In an embodiment, the system comprises a first and a second packer assembly, wherein the first and second packer assembly are configured so that they seal an interval of interest within the wellbore when the inflatable sections of each of the packer assemblies are inflated.

In an embodiment, the packer assembly further comprises a second fiber optic sensor disposed at least one of the first and second ends.

In an embodiment, the system comprises a wireline cable coupled to the packer assembly to deploy the packer assembly in the borehole. In such case, the wireline cable may comprise a fiber optic cable coupled to the fiber optic sensor and to the optical source and data acquisition system, for communication purposes.

In an embodiment, the optical source and data acquisition system are situated at surface.

In an embodiment, the formation is a hydrocarbon-producing formation.

The disclosure also relates to an inflatable instrument packer element, comprising an inflatable section extending between a first end and a second longitudinal end, the inflatable section made of an elastomeric material reinforced with a plurality of reinforcement cables and operable to be inflated to seal an interval of interest within a borehole; wherein each reinforcement cable extends essentially along a longitudinal axis of the packer element, and a fiber optic sensor set in the elastomeric material between the first and second longitudinal ends and extending along a length of one of the reinforcement cable.

In an embodiment, the fiber optic sensor is configured to respond to events occurring within a region of interest.

In an embodiment, the inflatable instrument packer element comprises a feedthrough disposed at least one of the first end and the second longitudinal end of the inflatable section to couple the fiber optic sensor to a communications medium for the communication of data corresponding to the detected events.

In an embodiment, the fiber optic sensor comprises an optical fiber set in the elastomeric material between adjacent cables.

In an embodiment, the fiber optic sensor is configured as a distributed fiber optic sensor.

In an embodiment, the packer element further comprises a second fiber optic sensor disposed between the first and second longitudinal ends.

In an embodiment, the packer element has a crimped skirt at least at one of the longitudinal end to crimp the reinforcement cables on an inner mandrel of the packer element, and the fiber optic sensor is routed above the crimped skirt.

In an embodiment, the fiber is routed between the crimped skirt and an injection skirt and wherein the void between the crimped and injection skirts is sealed with plastic material.

What is claimed is:

1. A method of evaluating characteristics of an earth formation, comprising:

deploying a packer assembly in a borehole penetrating an earth formation, the packer assembly comprising an instrumented inflatable packer element including fiber optic sensors, wherein the packer assembly is deployed in the borehole in a deflated configuration, wherein the fiber optic sensors comprise optical fibers set in the instrumented inflatable packer elements, wherein the instrumented inflatable packer element comprises an inflatable section extending between a first end and a second end, the inflatable section made of an elastomeric material reinforced with a plurality of cables, wherein the optical fiber is set within the elastomeric material between adjacent cables, and wherein the optical fiber and the cables extend essentially along a longitudinal axis of the packer element;

inflating the instrumented inflatable packer elements;

detecting, using the fiber optic sensors, events occurring in the earth formation; and transmitting data corresponding to the detected events to a surface processing system.

2. The method as recited in claim 1, wherein the fiber optic sensors further comprise a coil of optical fiber disposed at least one of the first and second ends.

3. The method as recited in claim 1, comprising determining at least one characteristic of the formation based on the detected events.

4. The method as recited in claim 1, wherein the method includes deforming the formation contacting the packer, where the events are detected while the packer is inflated and/or deflated.

5. The method as recited in claim 4, wherein the detected events are deformation events wherein the method includes determining an in-situ stress of the formation based on the detected events.

6. The method as recited in claim 1, wherein:

deploying comprises deploying a dual packer assembly in the borehole, the packer assembly comprising a first and second instrumented inflatable packer elements;

inflating comprises inflating the first and second packer elements, the method including pressurizing the sealed interval of interest to hydraulically fracture the formation, wherein the events are detected while the formation is hydraulically fractured.

7. The method as recited in claim 1, wherein the detected events are acoustic events wherein the method includes determining at least one of a fracturing efficiency and of a fracture plane orientation based on the detected events.

8. The method as recited in claim 1, wherein the event is an acoustic and/or a deformation event.

9. An instrumented packer system for evaluating an earth formation, comprising:

at least a packer assembly deployed in a borehole extending from an earth surface into a formation, the at least one packer assembly comprising an inflatable section extending between a first end and a second longitudinal end, the inflatable section made of an elastomeric material reinforced with a plurality of reinforcement cables and operable to be inflated within a borehole; wherein each reinforcement cable extends essentially along a longitudinal axis of the packer element, a fiber optic sensor set in the elastomeric material between the first and second longitudinal ends and extending along a length of and in the same orientation as one of the reinforcement cable, the fiber optic sensor configured to respond to events occurring within a region of interest;

an optical source to launch optical pulses into the distributed fiber optic sensor; and a data acquisition system coupled to the distributed fiber optic sensor to detect backscattered optical signals generated by the distributed fiber optic sensor in response the launched optical pulses to determine characteristics of the formation.

10. The system as recited in claim 9, comprising a first and a second packer assembly, wherein the first and second packer assembly are configured so that they seal an interval of interest within the wellbore when the inflatable sections of each of the packer assemblies are inflated.

11. The system as recited in claim 9, further comprising a wireline cable coupled to the packer assembly to deploy the packer assembly in the borehole wherein the wireline cable comprises a fiber optic cable coupled to the fiber optic sensor and to the optical source and data acquisition system.

12. An inflatable instrument packer element, comprising:

an inflatable section extending between a first end and a second longitudinal end, the inflatable section made of an elastomeric material reinforced with a plurality of reinforcement cables and operable to be inflated within a borehole; wherein each reinforcement cable extends essentially along a longitudinal axis of the packer element, a fiber optic sensor set in the elastomeric material between the first and second longitudinal ends and extending along a length of one of the reinforcement cable; and a crimped skirt at least at one of the longitudinal end to crimp the reinforcement cables on an inner mandrel of the packer element, wherein the fiber optic sensor is routed radially outward of the crimped skirt.

13. The inflatable instrument packer element according to claim 12, comprising a feedthrough disposed at least one of the first end and the second longitudinal end of the inflatable section to couple the fiber optic sensor to a communications medium for the communication of data corresponding to the detected events.

14. The packer element as recited in claim 12, wherein the fiber optic sensor comprises an optical fiber set in the elastomeric material between adjacent cables.

15. The packer element as recited in claim 12, further comprising a second fiber optic sensor disposed between the first and second longitudinal ends.

16. The packer element as recited in claim 12, wherein the fiber is routed between the crimped skirt and an injection skirt and wherein the void between the crimped and injection skirts is sealed with plastic material.

* * * * *